US005915305A

United States Patent [19]

Ward et al.

[11] Patent Number: 5,915,305

[45] Date of Patent: Jun. 29, 1999

[54] METHOD AND APPARATUS FOR HANDLING SHEET MATERIAL

[76] Inventors: Donald A. Ward, 21831 N.W. 6th St., Pembroke Pines, Fla. 33029; Stephan D. Ward, 16200 VanBuren Blvd., Riverside, Calif. 92504

[21] Appl. No.: 09/067,753

[22] Filed: Apr. 27, 1998

[51] Int. Cl.[6] ..... B41F 1/28

[52] U.S. Cl. ..... 101/416.1; 101/378

[58] Field of Search ..... 101/416.1, 419, 101/420, 375, 376, 378

[56] References Cited

U.S. PATENT DOCUMENTS

| | | | |
|---|---|---|---|
| 944,607 | 12/1909 | Goldsmith | 118/261 |
| 1,152,596 | 9/1915 | Boucher | 492/48 |
| 1,231,141 | 6/1917 | Dillis | 101/422 X |
| 1,255,603 | 2/1918 | Hartmann | 101/415.1 |
| 3,261,288 | 7/1966 | Dickerson | 101/420 |
| 4,023,967 | 5/1977 | McGibbon | 96/1 LY |
| 4,227,459 | 10/1980 | Jeschke | 101/183 |
| 4,237,786 | 12/1980 | Sanford | 101/378 |
| 4,402,267 | 9/1983 | DeMoore | 101/419 |
| 4,691,632 | 9/1987 | DeMoore | 101/422 |
| 4,694,750 | 9/1987 | Greene | 101/420 |
| 5,046,421 | 9/1991 | DeMoore | 101/420 |
| 5,312,488 | 5/1994 | Bolza-Schunemann et al. | 101/375 |
| 5,415,098 | 5/1995 | Ward | 101/493 |
| 5,603,264 | 2/1997 | DeMoore et al. | 101/419 |

*Primary Examiner*—Edgar Burr
*Assistant Examiner*—Minh H. Chau
*Attorney, Agent, or Firm*—Oltman, Flynn & Kubler

[57] ABSTRACT

A printed product transfer assembly for supporting and carrying printed product from one station in a printer apparatus to another station includes a transfer structure including a product conveying surface, a blanket including fiberglass having several outwardly protruding fiberglass fibers and being secured snugly over the conveying surface; a flexible resilient material secured snugly over the blanket and engaged against circumferential movement relative to the blanket by the fiberglass fibers, and having several ridges for engaging and conveying the printed products and for cushioning the printed products to prevent marring of printing ink. The printed product transfer assembly preferably still further includes a delivery shaft; a transfer cylinder including releasibly interconnected first and second longitudinal cylinder half portions, each half portion including an arched outer shell segment forming a portion of a printed product conveying surface and first and second shell segment half hub structures secured respectively within and to the first and second longitudinal cylinder half portions, the half hub structures including delivery shaft receiving structure and hub inter-connection elements releasibly joining the first and second half hub structures together; and a transfer cylinder anti-rotation collar for fixing the transfer cylinder against rotation about and relative to the delivery shaft.

10 Claims, 3 Drawing Sheets

METHOD AND APPARATUS FOR HANDLING SHEET MATERIAL

BACKGROUND OF THE INVENTION

1. Field of the Invention

The present invention relates generally to the field of devices for supporting and transferring printed sheets from one printing press station to another. More specifically the present invention relates to a transfer structure such as a cylinder which is wrapped first in a fiberglass belting. The belting is preferably abraded with a wire brush to raise fibers, and then wrapped in a ridged netting material such as ultra-soft cotton fabric, which is fit snugly around the cylinder, but not so tightly as to pull the ridging out of the netting material, for supporting and transferring a freshly printed sheet. The ridges serve to engage the sheet much like teeth while cushioning and yielding as the freshly printed surface of the sheet bears against the ridges to prevent smearing or other marring of wet ink. The cylinder preferably includes a conveying surface with a matte finish to minimize slipping of the netting material relative to the conveying surface.

The transfer cylinder preferably includes releasibly interconnected first and second longitudinal cylinder half portions, each half portion having an arched outer shell segment forming a portion of a sheet conveying surface and first and second shell segment half hub structures secured respectively within the first and second longitudinal cylinder half portions, the half hub structures including delivery shaft receiving structure and hub interconnection elements releasibly joining the first and second half hub structures together.

A method is also provided of covering a conveying surface of a transfer structure such as a cylinder with a fiberglass blanket, abrading the blanket with a wire brush to raise fibers, wrapping the blanket with a yielding ridged netting material, and tightening the netting material to a tension level just short of pulling out the ridges, then causing the transfer structure to move relative to a printing press station in such a way as to pick up the printed product and carry it to another such station.

2. Description of the Prior Art

There have long been transfer structures for supporting and conveying freshly printed sheets of material from one station of a printing press to the next station. A key design objective has been for the structure to sufficiently grip the sheet to move it without smearing or smudging the wet ink on its surface.

One such prior transfer structure is that of DeMoore, U.S. Pat. No. 4,402,267, issued on Sep. 6, 1983. DeMoore teaches a method and apparatus for handling printed sheet material, including a skeleton transfer cylinder. The cylinder is coated with a fluorocarbon composite material to provide a cushioning effect for the sheets. The cylinder is wrapped in a piece of fabric which is secured loosely for the intended purpose of preventing the transfer of wet ink from one sheet to a successive sheet. The fabric is treated with an absorbance retarding substance such as SCOTCHGARD™. A problem with DeMoore is that this structure is not well suited to small printing presses. Another problem is that loose, flopping fabric can bunch and wear quickly. The flopping fabric has a tendency to slap the tail end of the impression cylinder and create an ink build-up on the tail end of the transfer cylinder, and the netting thereon, which causes marring of the surface of the next sheet of paper that is transferred.

Ellis, U.S. Pat. No. 1,231,141, issued on Jun. 26, 1917, discloses a fabric for printers' blankets and other purposes.

Ellis describes a multiple layer blanket for packing impression cylinders of newspaper presses. The outer layer face is felt covered. It appears unclear whether the blanket material is intended to fit tightly or loosely over an impression cylinder. A problem with Ellis is that felt can mar a freshly printed surface. Another problem is that the multiple layer construction would likely be costly.

Goldsmith, U.S. Pat. No. 944,607, issued on Dec. 28, 1909, teaches tile coating machinery. Goldsmith includes a coating roll having ribbed rubber periphery enclosed within a foraminous metallic sleeve. The foraminous sleeve is loosely mounted on the roll. A problem with Goldsmith is that the metallic sleeve would likely damage printed sheets and mar wet ink on their surfaces.

Boucher, U.S. Pat. No. 1,152,596, issued on Sep. 7, 1915, reveals a covering for use on a suction-roll which is used on paper making machines. The covering consists of a coarse knit sleeve, preferably knit from wool worsted yarn and adapted to be stretched over the suction roll. A problem with Boucher is that the coarse sleeve would likely be too rigid to convey freshly inked sheets without marring. Another problem is that these sleeves might slip on a typical smooth surfaced transfer cylinder.

Dickerson, U.S. Pat. No. 3,261,288, issued on Jul. 19, 1966, discloses an anti-smear jacket for a printing press transfer drum. Dickerson uses a series of elongated resilient spacing elements or strips on the outside of a transfer cylinder instead of fabric. A problem with Dickerson is that the hard, resilient strips could mar wet ink on a sheet.

McGibbon, U.S. Pat. No. 4,023,967, issued on May 17, 1977, reveals an electrophotographic liquid development method in which a uniform substantial interface contact is maintained. McGibbon uses a roller device having a core loosely circumscribed axially with a flexible sleeve, with a space between the core and the sleeve being substantially uniform. This space is filled with a curable plastic foam material to obtain a uniform contact and nip width when in rotational contact with a cooperating surface. A problem with McGibbon is that the loose mounting of the sleeve on the core promotes marring and rapid sleeve wear. Another problem is that the resilient full sleeve contact can also increase the likelihood of marring.

An operation manual, entitled "Heidelberg M-Offset Multicolour-Perfector", dated October 1981, discloses a loosely mounted glass-bead blanket mounted on a transfer cylinder. A wire gauze material is used instead of a fabric. The problems presented by Heidelberg are essentially those of Dickerson.

Hartmann, U.S. Pat. No. 1,255,603, filed Feb. 3, 1916, discloses a printing cloth for presses where the cloth is tensioned around a printing roller or cylinder to convey printed stock. The outer conveying surface of the cylinder is grooved. A problem with Hartmann is that the cloth itself is not stated to be ridged or grooved to engage and convey the printed stock, which makes smearing and other marring likely.

U.S. Pat. No. 5,415,098, issued on May 16, 1995 to the present applicant, discloses a method and apparatus for handling sheet material using ridged netting. This prior apparatus placed ridged netting directly onto the transfer cylinder, making it necessary for the cylinder contact surface to be rough beyond the natural unfinished texture to prevent circumferential movement of the netting. The prior apparatus also required the conventional amount of effort to remove and reinstall the cylinder on the chain delivery shaft.

It is thus an object of the present invention to provide a method and apparatus for transferring and supporting freshly printed sheets between printing press stations without marring the wet ink.

It is another object of the present invention to provide such a method and apparatus which is well suited for use on many of the smaller printing presses.

It is still another object of the present invention to provide such a method and apparatus which operate with minimal wear and maximum longevity.

It is a further object of the present invention to provide such an apparatus including a transfer cylinder which is quickly and easily removed and remounted.

It is finally an object of the present invention to provide such a method and apparatus which are reliable and produce a printed sheet product of consistent high quality.

SUMMARY OF THE INVENTION

The present invention accomplishes the above-stated objectives, as well as others, as may be determined by a fair reading and interpretation of the entire specification.

A printed product transfer assembly is provided for supporting and carrying printed products from one station in a printer apparatus to another station, including a transfer structure including a printed product conveying surface, a blanket including fiberglass having many outwardly protruding fiberglass fibers and being secured snugly over the conveying surface; a flexible resilient material secured snugly over the blanket and engaged against circumferential movement relative to the blanket by the fiberglass fibers, and having several ridges for engaging and conveying the printed products and for cushioning the products to prevent marring of printing ink.

The blanket preferably additionally includes silicone. The netting material preferably includes an ultra-soft cotton fabric. The conveying surface preferably includes a matte finish. The transfer structure is preferably a transfer cylinder. The netting material is optionally secured over the conveying surface with hook and loop fasteners.

A method is provided of preparing a printing press transfer structure having a printed product conveying surface for transferring printed products from one station of a printer apparatus to another station, including the steps of covering at least part of the conveying surface with a flexible blanket comprising fiberglass fibers; covering at least part of the blanket with yielding ridged material; tightening the ridged material over the conveying surface to a tension level sufficient to take up slack in the material but insufficient to pull out the ridges. The method preferably includes the additional step of wire brushing the blanket to cause fiberglass fibers to protrude, to more securely hold the ridged material against motion relative to the blanket.

A printed product transfer assembly is still further provided for supporting and carrying printed products from one station in a printer apparatus to another station, including a delivery shaft; a transfer cylinder including releasibly interconnected first and second longitudinal cylinder half portions, each half portion including an arched outer shell segment forming a portion of a printed product conveying surface and first and second shell segment half hub structures secured respectively within and to the first and second longitudinal cylinder half portions, the half hub structures including delivery shaft receiving structure and hub interconnection elements releasibly joining the first and second half hub structures together; and a transfer cylinder anti-rotation collar for fixing the transfer cylinder against rotation about and relative to the delivery shaft.

The anti-rotation structure preferably includes a collar structure having half hub engaging elements and a flexible resilient material secured tightly around the conveying surface and having several ridges for engaging and conveying products.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
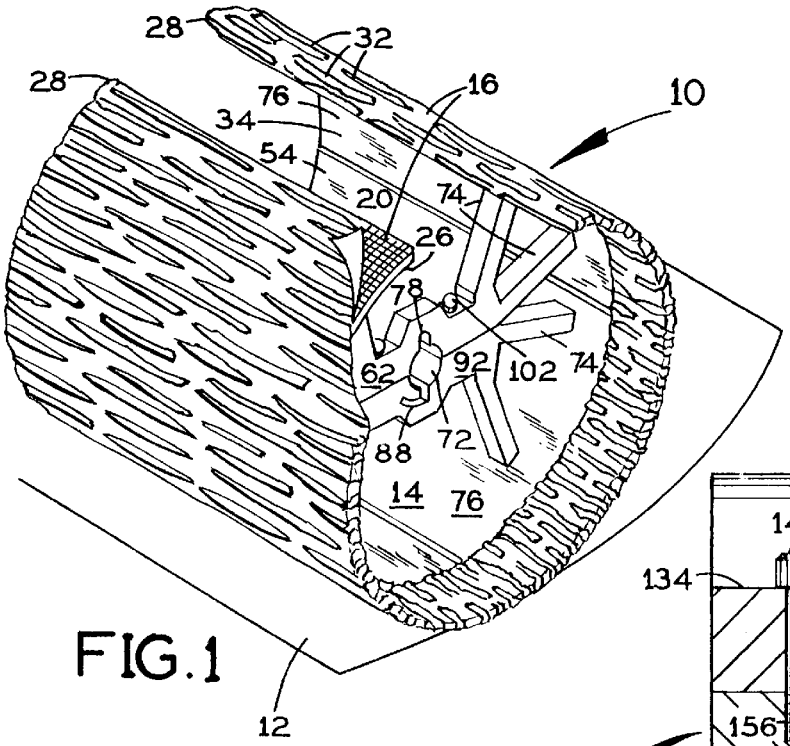
FIG. 1 is a perspective view of the complete inventive transfer cylinder. The cylinder is covered with the silicone impregnated, fiberglass blanket and the netting material. The blanket is shown in the pulled back region of the netting material.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 4:
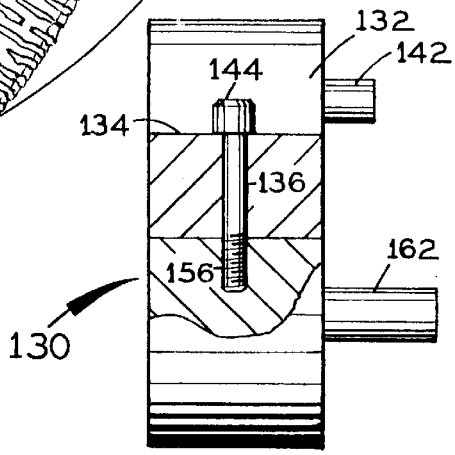
FIG. 4 is an edge view of either one of the illustrated mounting collars, with a portion cut away to reveal one of the fastener bolts.
Figure 2:
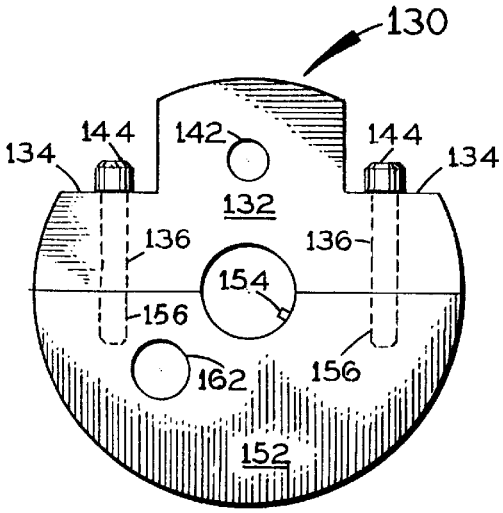
FIG. 2 is a side view of one of the cylinder mounting collars, showing the fastener bolts in broken lines where they are hidden and showing the locations of the first and the second mounting pins.
Figure 3:
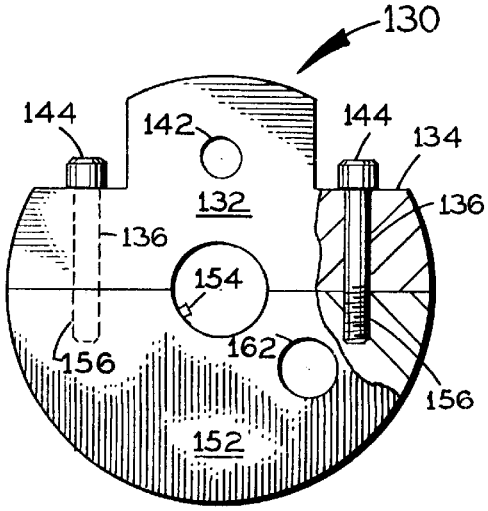
FIG. 3 is a side view of the other cylinder mounting collar as in FIG. 2, but showing the mirror image locations of the first and second mounting pins.
Figure 5:
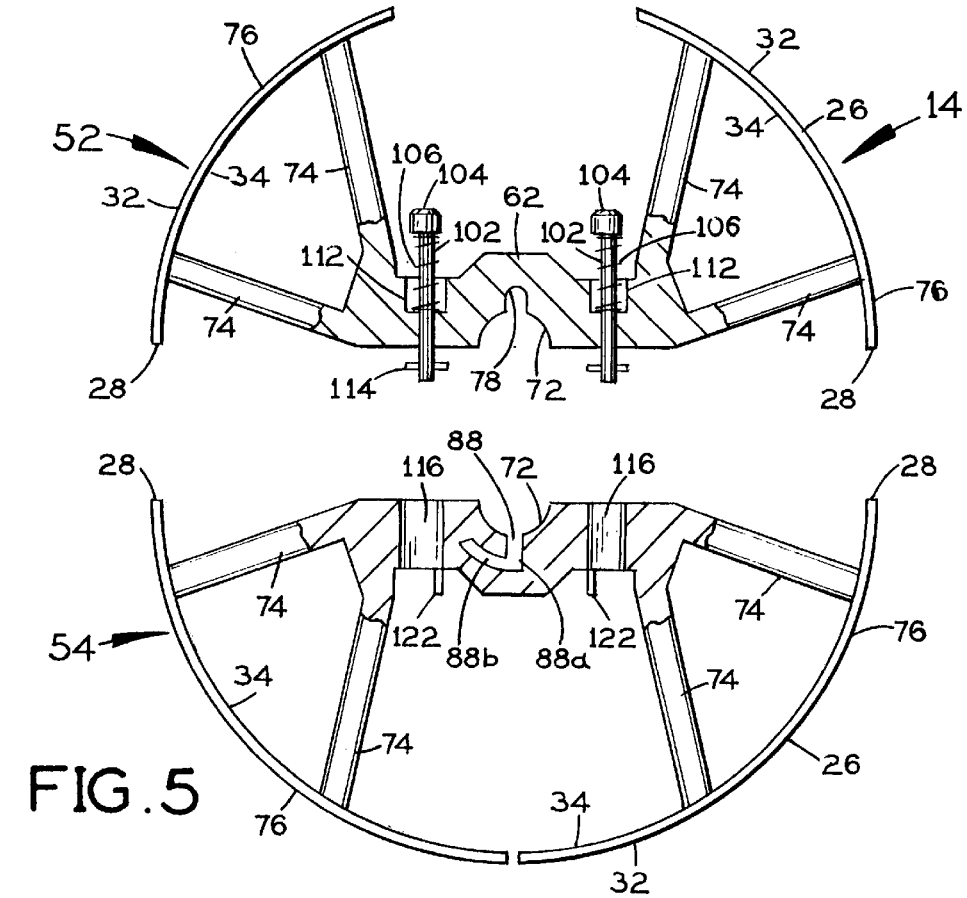
FIG. 5 is an end view of the inventive, longitudinally divided transfer cylinder, with the two cylinder halves shown separated from each other as they would be for removal of the cylinder from the chain delivery shaft.
Figure 6:
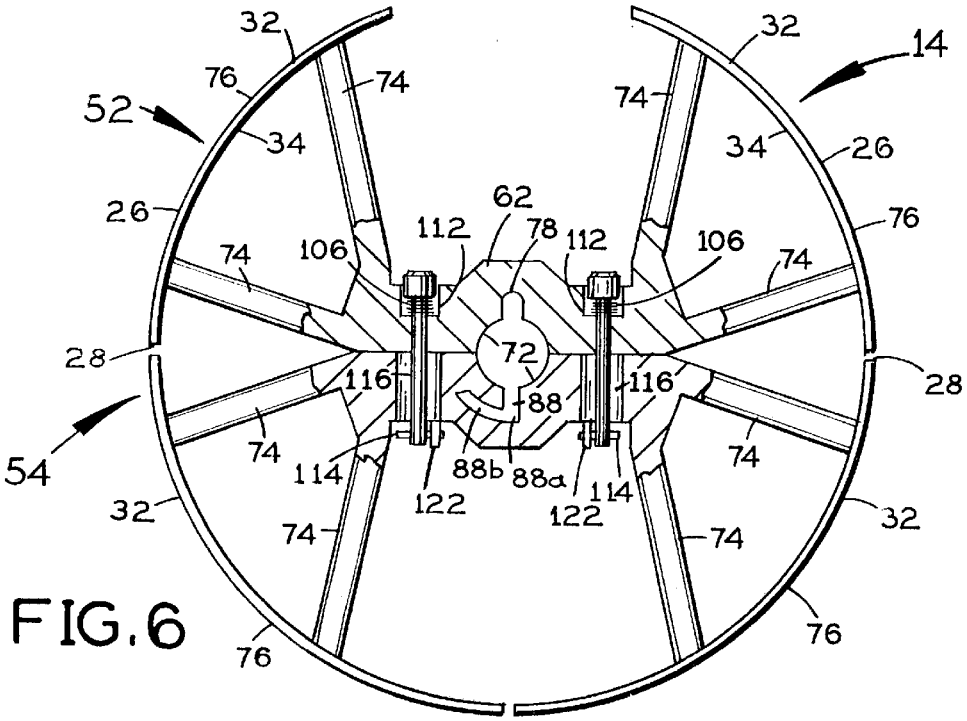
FIG. 6 is a view as in FIG. 5, but showing the two cylinder halves interconnected with the studs engaged.
Figure 7:
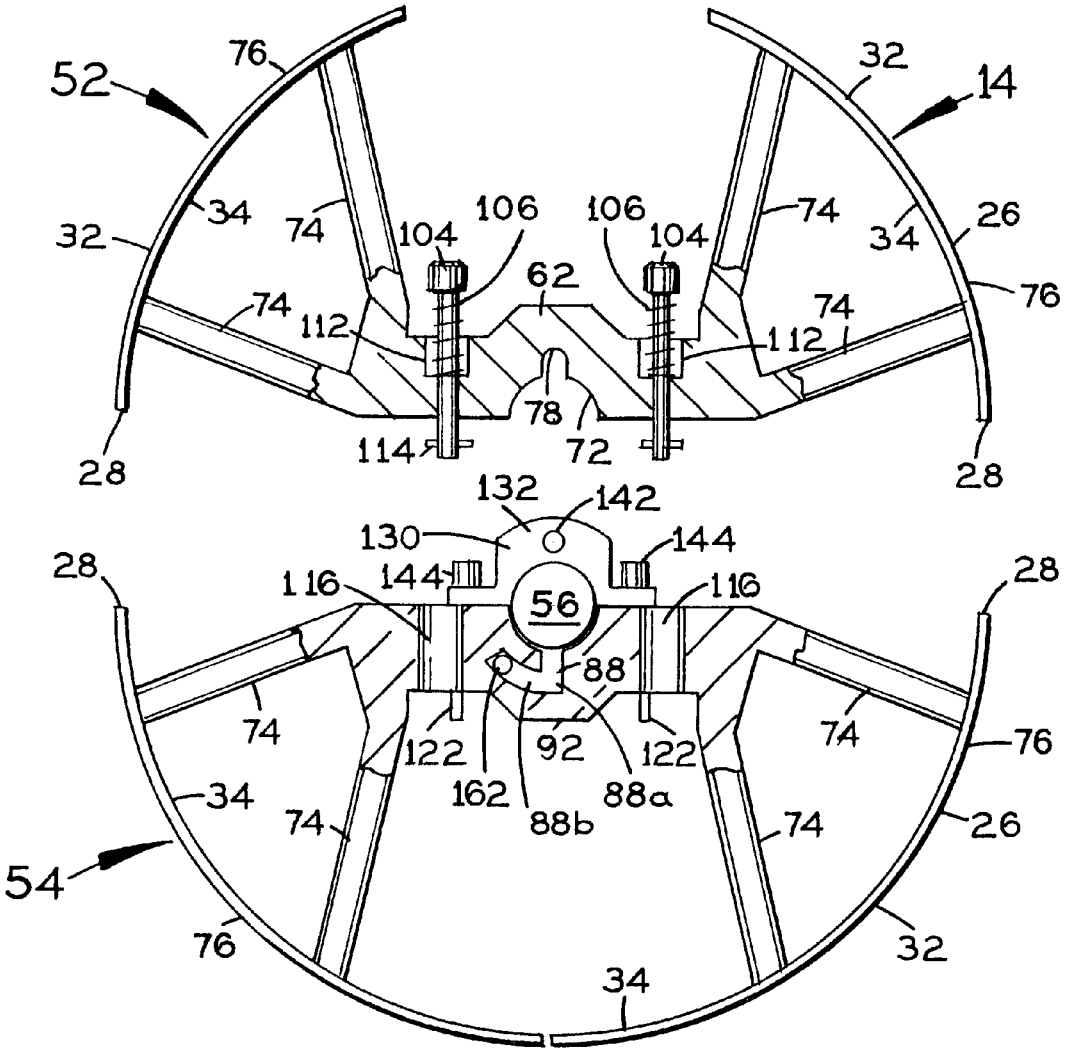
FIG. 7 is a view as in FIG. 5, with one of the mounting collars shown on the far side of the hub structure of the cylinder, engaging the lower cylinder half so the upper cylinder half can be set in place and fastened. The delivery shaft is illustrated as well.

Referring to FIGS. 1–7, a printed product 12 transferring assembly 10 is disclosed for supporting and conveying sheets, cards and other stock from one printing press station to another.

Cover Material

Assembly 10 preferably includes a transfer cylinder 14, described below in detail. Cylinder 14 is wrapped in a fiberglass blanket 20 which is preferably impregnated with silicon. Blanket 20 is in turn covered with a soft netting material 16 which is embossed or ridged. See FIG. 1. This material 16 may be an ultra-soft cotton fabric, and is also known in the printing industry as ridged netting or krinkle gauze.

Material 16 is fit tightly around blanket 20 and cylinder 14, but not so tightly as to pull the wrinkles or ridges 22 out of the material 16. Ridges 22 serve to engage the printed product 12 much like teeth while cushioning and yielding as each freshly printed product 12 bears against ridges 22 to prevent smearing or other marring of printed wet ink. Ridges 22 collapse and then resiliently return to substantially their original shape after a product 12 has been conveyed off of a cylinder 14.

Blanket 20 is wire brushed to increase the number of fiberglass fibers protruding outwardly from blanket 20, and these fiberglass fibers engage netting material 16 so that material 16 is held substantially fixed against circumferential movement relative to cylinder 14. The protruding fiberglass fibers also enhance the compressibility of the ridges and improve the cushioning effect, and thus improve the anti-marking qualities of the larger cylinders in the ridged fabric system by keeping the valleys of the ridged netting material 16 deep. This also extends the life of the netting material 16 because it helps the ridged material 16 to return from the compression and maintain its original cushioning shape, after being compressed by a freshly printed product 12.

A further and highly important function of compressible ridges 22 is that they automatically compensate for a changed opening distance between the blanket and the impression cylinders (not shown). The effective diameter of the cylinder 14 and netting material 16 is changed to accommodate the thickness difference between, for example, card stock and sheet, simply by the inherent compression and expansion of ridges 22 with differences in pressure against ridges 22. Furthermore, ridges 22 do not compress more than is needed to bring the diameter and the circumferential surface speed of the transfer cylinder 14 to the size needed to match the surface speed of the product 12 being printed and transported through the press. In this way ridges 22 and the silicone cloth base material, working together, compensate for the pull from tack plus the speed difference between printing a thin sheet of paper and a thick card stock without marking the freshly printed product 12.

Ridges 22 further compensate for compression from ink tack, which is the stickiness of the ink when it is being transferred from one surface to another. The ink tack that must be present for proper printing is controlled and formulated into the ink by the ink manufacturer. The ink tack on the material 16 pulls back on the printed product 12 as grippers are pulling the product 12 forward through the press. This causes the printed product 12 to compress the ridged material 16 that is on transfer cylinder 14.

The impregnated silicone in blanket 20 is a lubricant which is insufficient to free netting material 16 from blanket 20 fiber engagement, and yet is sufficient to permit fibers of the netting material 16 to slide freely against the nonprotruding blanket 20 fibers and thereby permit ridges 22 to freely collapse under product 12 pressure during printing. Silicone blanket 20 fabric is also resistant to extreme temperature changes, which is important such as when high heat infrared dryers are used to dry the freshly printed sheet, often on the delivery end of the press.

Blanket 20 is preferably secured with hook and loop fasteners (not shown) such as VELCRO™ within cylinder 14 end rims 26. Material 16 is secured along longitudinal edges 28 or inner surfaces 34 of cylinder 14. Fibers of material 16 may themselves engage or be engaged by the fasteners.

Cylinder 14 preferably includes a rough finish on its outer surface 32 to minimize slipping of material 16 relative to cylinder 14, to further minimize marring of wet ink. The finish is preferably simply the natural texture of unfinished aluminum, although it may be a tumbled or sandblasted matte finish. The rough finish effectively engages the fibers of blanket 20 to keep slippage of blanket 20 non-existent.

Cylinder Covering Method

In practicing the invention, the following method may be used. A conveying or carrying surface 32 of a transfer structure such as a cylinder 14 is covered with a blanket 20 containing fiberglass fibers, preferably having silicone impregnated into its surface, and is preferably abraded lightly with a wire brush or equivalent tool, and is then covered with a yielding ridged material 16. See FIG. 1. The material 16 is tightened over blanket 20 to a tension magnitude sufficient to take up slack in material 16 but insufficient to pull out ridges 22. Then transfer cylinder 14 is made to move relative to a freshly printed product 12 at a printing press station in such a way as to pick up product 12 and carry it to another printing press station.

Improved Transfer Cylinder

Cylinder 14 is preferably divided into longitudinal first and second cylinder half portions 52 and 54, which are quickly and easily removed from and remounted onto the chain delivery shaft 56 of a press. See FIGS. 5–7. First half portion 52 includes a first half hub 62 in the form of a metal block having a semi-circular shaft-receiving half port 72. Each longitudinal end of first half hub 62 splits to form a pair of spokes 74, and an arched cylinder shell segment 76 is mounted on each pair of spokes 74. Shell segments 76 are preferably formed of unfinished aluminum. The wide separation between shell segments 76 on first half portion 52 is a gripper bar slot for duplicators for timing purposes in drawing up products 12. The narrow separation between shell segments 76 on second half portion 54 is simply provided because of the greater ease of manufacturing small shell segments 76. First half hub 62 includes a first pin receiving notch 78 extending centrally from half port 72.

Near each longitudinal end of first half hub 62 a first fastener bore 82 is provided, which is oriented directly toward the opposing second half hub 92. Second half hub 92 takes the form, once again, of a metal block having a semi-circular shaft-receiving half port 72, with a second pin receiving notch 88, in the form of an L-slot. Notch 88 includes an L-slot radial leg 88*a,* and an L-slot circumferential leg 88*b*.

Second half hub 92 includes at each longitudinal end a second fastener bore 84 which registers and is coaxial with a corresponding first fastener bore 82. A threadless stud 102 having a head 104, preferably a threadless ALLEN™ screw, is slidably fitted through each first fastener bore 82 and has between the head 104 and the first half hub 62 a coil spring 106 to bias the stud 102 outwardly from half hub 62. A counterbore segment 112 of each first fastener bore 82 is preferably provided in first half hub 62 to receive coil springs 106. An anchor pin 114 passes laterally though the end of each stud 102 opposite the stud head 104. A pin slot 116 extends diametrically from the sides of each second fastener bore so that as the stud 102 slides through a second fastener bore 84 the anchor pin 114 slides within the bore pin slot 116. When the stud 102 is fully through the second fastener bore 84, the stud 102 is rotated relative to the bore 84 so that the pin 114 is not aligned with the pin slot 116. As a result the coil spring 106 pulls the anchor pin 114 flat against the surface of the second half hub 92 and releasibly locks the stud 102 in interconnecting engagement though half hubs 62 and 92. Pins 114 rotate an optimum angular distance and then are stopped by contact with stop elements 122, which prevent over-rotation of pins 114 so that they do not unintentionally realign with pin slots 116. The half hubs 62 and 92 are released from each other by rotating each stud 102 to again align the pin 114 with the pin slot 116 so that the stud 102 and pin 114 slide back through and out of second half hub 92.

To hold cylinder 14 against rotation about chain delivery shaft 56 and against longitudinal sliding along shaft 56, a mounting collar 130 is provided on each side of interconnected half hubs 62 and 92. See FIGS. 2–4. Each mounting collar 130 includes a semi-annular half portion 132 having two shoulder notches 134, each shoulder notch 132 including a fastener bore 136. A first mounting pin 142 protrudes perpendicularly from a first face 144 of first collar half portion 132 between shoulder notches 132. A semi-annular second half portion 152 has a key 154 for fitting into a keyway (not shown) in shaft 152, and threaded fastener bores 156 registering with fastener bores 82 and 84 in first collar half portion 132, into which fastener bolts 144 are engaged to hold first and second collar half portions 132 and 152 together. Second half portion 152 additionally has a second mounting pin 162 radially offset from first mounting pin 142, such as by forty-five degrees. Mounting pins 142 and 162 of the two collars 130 are positioned as mirror images to directly oppose each other when fitted onto shaft 56.

To mount cylinder half portions 52 and 54, the half port 72 of second half hub 92 is fitted against shaft 56, and the second mounting pins 162 of two opposing mounting collars 130 are fitted into the radial leg of L-slot 88*a,* and then slid into the circumferential leg of L-slot 88*b.* This engages second half hub 92 so that cylinder half portion 54 remains suspended from shaft 56 while cylinder first half portion 52 is secured to second cylinder half portion 54 with studs 102 as above described. The first mounting pins 142 of collars 130 slide radially into notch 78 of first half hub 62 during this mounting to secure cylinder first half portion 52 against rotation about shaft 56.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim as my invention:

1. A printed product transfer assembly for supporting and carrying printed products from one station in a printer apparatus to another said station, comprising:

a transfer structure comprising a product conveying surface, a blanket comprising fiberglass having a plurality of outwardly protruding fiberglass fibers and being secured snugly over said conveying surface;

a flexible resilient material secured snugly over said blanket and engaged against circumferential movement relative to said blanket by said fiberglass fibers, and having a plurality of ridges for engaging and conveying said products and for cushioning said products to prevent marring of printing ink.

2. An apparatus according to claim 1, wherein said blanket additionally comprises silicone.

3. An apparatus according to claim 1, wherein said material comprises an ultra-soft cotton fabric.

4. An apparatus according to claim 1, wherein said conveying surface comprises a matte finish.

5. An apparatus according to claim 1, wherein said transfer structure is a transfer cylinder.

6. An apparatus according to claim 1, wherein said material is secured over said conveying surface with hook and loop fastener means.

7. A method of preparing a printing press transfer structure having a product conveying surface for transferring printed products from one station of a printer apparatus to another station, comprising the steps of:

covering at least part of said conveying surface with a flexible blanket comprising fiberglass fibers;

covering at least part of said blanket with yielding ridged material;

tightening said ridged material over said conveying surface to a tension level sufficient to take up slack in said material but insufficient to Pull out said ridges; and wire brushing said blanket to cause fiberglass fibers to protrude, to more securely hold said ridged material against motion relative to said blanket.

8. A printed product transfer assembly for supporting and carrying printed products from one station in a printer apparatus to another said station, comprising:

a transfer structure comprising a product conveying surface, a blanket comprising fiberglass having a plurality of outwardly protruding fiberglass fibers and being secured snugly over said conveying surface;

a flexible resilient material secured snugly over said blanket and engaged against circumferential movement relative to said blanket by said fiberglass fibers, and having inward and outward material faces and a plurality of wrinkles with crests in said outward material face producing corresponding troughs in said inward material face, wherein said crests define collapsible ridges for engaging and conveying said products and for cushioning said products to prevent marring of printing ink.

9. A printed product transfer assembly for supporting and carrying printed products from one station in a printer apparatus having a delivery shaft to another said station, comprising:

a transfer cylinder comprising releasibly interconnected first and second longitudinal cylinder half portions, each said half portion comprising an arched outer shell segment forming a portion of a product conveying surface and first and second shell segment half hub structures secured respectively within and to said first and second longitudinal cylinder half portions, said half hub structures comprising delivery shaft receiving means, said first half hub structure delivery shaft receiving means comprising hub interconnection means releasibly connecting said first and second half hub[2] structures together;

and transfer cylinder anti-rotation collar means, for fixing said transfer cylinder against rotation about and relative to said delivery shaft, said anti-rotation collar means comprising first half hub structure releasible engaging means for releasibly connecting said first half hub structure to said delivery shaft while said second half hub structure is secured to said first half hub structure.

10. An assembly according to claim 9, wherein said first half hub structure releasible engaging means comprises an engaging slot in said first half hub structure delivery shaft receiving means, said engaging slot extending both radially outward from and circumferentially about said delivery shaft receiving means, and further comprising an engaging pin protruding laterally from said anti-rotation collar means and positioned to removably fit into said engaging slot to releasibly interlock said first half hub structure and said anti-rotation collar means.

* * * * *